United States Patent [19]

Torino

[11] Patent Number: 4,949,130

[45] Date of Patent: Aug. 14, 1990

[54] HEAT-FIXING APPARATUS

[75] Inventor: Mitsuhiro Torino, Fukaya, Japan

[73] Assignee: Hitachi Metals, Ltd, Tokyo, Japan

[21] Appl. No.: 225,993

[22] Filed: Jul. 29, 1988

[30] Foreign Application Priority Data

Jul. 30, 1987 [JP] Japan ..... 62-190988
Apr. 21, 1988 [JP] Japan ..... 63-53976

[51] Int. Cl.[5] ..... G03G 15/20

[52] U.S. Cl. ..... 355/282; 355/285; 355/289; 355/290; 355/295

[58] Field of Search ..... 355/3 FU, 15, 283, 290, 355/282, 283, 285, 289, 290, 295; 219/216; 118/60, 101; 432/60

[56] References Cited

U.S. PATENT DOCUMENTS

| | | | |
|---|---|---|---|
| 3,811,821 | 5/1974 | Ariyama et al. | 219/216 X |
| 4,219,327 | 8/1980 | Idstein | 355/290 X |
| 4,231,653 | 11/1980 | Nagahara et al. | 355/295 X |
| 4,514,486 | 4/1985 | Shirose et al. | 355/285 X |
| 4,518,244 | 5/1985 | Kageyama et al. | 355/3 FU |
| 4,568,275 | 2/1986 | Sakurai . | |
| 4,579,802 | 4/1986 | Kishi et al. | 355/290 X |
| 4,769,676 | 9/1988 | Mukai et al. | 355/15 |
| 4,796,046 | 1/1989 | Suzuki et al. | 355/3 FU |

FOREIGN PATENT DOCUMENTS

| | | | |
|---|---|---|---|
| 51-10108 | 4/1976 | Japan . | |
| 0070827 | 6/1978 | Japan | 355/282 |
| 57-44168 | 3/1982 | Japan . | |
| 56-52784 | 5/1982 | Japan . | |
| 57-105760 | 7/1982 | Japan . | |
| 0195872 | 11/1983 | Japan | 355/15 |
| 0217010 | 12/1984 | Japan . | |
| 0205561 | 10/1985 | Japan . | |

*Primary Examiner*—A. T. Grimley
*Assistant Examiner*—Matthew S. Smith
*Attorney, Agent, or Firm*—Finnegan, Henderson, Farabow, Garrett & Dunner

[57] ABSTRACT

A heat-fixing apparatus includes a heating roll constituted by a cylindrical core coated with a heat-resistant, elastic layer and a resin surface layer having release properties, which is to be brought into contact with a toner inage-bearing sheet member; a pressure roll in pressed contact with said heating roll to provide a nip portion therebetween; a cleaning roll made of a metal material and rotatably pressed to said heating roll; and a scraper in slidable contact with the outer surface of said cleaning roll. The scraper includes a scraper element held between a support plate and a spaced holding plate by screws extending through longitudinally enlarged holes in the scraper element, to prevent thermal expansion-induced deformation of the scraper element.

4 Claims, 1 Drawing Sheet

HEAT-FIXING APPARATUS

BACKGROUND OF THE INVENTION

The present invention relates to a heat-fixing apparatus adapted to be mounted in image-forming apparatuses such as electrophotographic apparatuses and electrostatic printing apparatuses for fixing a toner image to a paper or other sheet member between a pair of rolls rotating at some contact pressure, at least one of which is provided with a heating means, and more particularly to an improved heat-fixing apparatus whose rolls are always kept clean to prevent the contamination of papers or other image-bearing sheets.

Conventionally known as a fixing apparatus for use in image-forming apparatuses is a heat-fixing apparatus of a heating roll type comprising a heating roll and a pressure roll arranged opposite to each other, the heating roll being constituted by a metal cylinder having good thermal conductivity coated with a non-adherent, heat-resistant layer and containing a heat source such as an infrared lamp, a halogen lamp or a nickel-chromium wire therein, and the pressure roll being constituted by a metal cylinder coated with a heat-resistant, elastic surface layer. In the above heat-fixing apparatus, the fixation of a toner image formed on a sheet is carried out by energizing a heat source to heat the surface of the heating roll to temperatures necessary for fixing of the toner, rotating the heating roll and the pressure roll in contact with each other at a proper contact pressure, and passing the sheet bearing the toner image between the two rolls.

In such a heat-fixing apparatus, it is particularly important to prevent "offset" of toner image borne on the sheet in order to obtain a high-quality fixed image. More specifically, the toner to be fixed to a toner image-bearing sheet member should be prevented from being transferred onto the heating roll partially while passing through a gap between the pressure roll and the heating roll and then adhered to the image-bearing sheet member again.

Conventionally used to prevent offset of the fixed image is a heating roll coated with resins having good release properties such as polytetrafluoroethylene [PTFE], perfluoroalkoxy-tetrafluoroethylene copolymers [PFA], etc. Such a heating roll, however, has insufficient fixing capability because of low elasticity, and also it is likely to incur surface damage. To eliminate these defects, a proposal was made to provide a heating roll coated with a layer of a mixture of a fluorine rubber and a fluorine resin, which is baked to have a fluorine resin layer as an outermost layer [U.S. Pat. No. 4,568,275]. This heating roll, however, is poor in durability. Specifically speaking, because it has a fluorine resin surface layer of only several μm in thickness, the surface layer is worn out by producing only several tens of thousands of copies due to contact with a cleaning member, etc.

Thus, a proposal was made to provide a heating roll having a fluorine resin layer over the above mixture layer [Japanese Patent Laid-Open No. 59-217010].

An attempt was also made to propose/provide a heating roll and a pressure roll, each of which is constituted by a core cylinder coated with a heat-resistant, elastic layer and then with a fluorine resin layer [U.S. Pat. No. 4,219,327, EPA 0186314].

None of these apparatuses using heating rolls having multilayer structures of core-heat resistant, elastic layer-release layer, however, succeeded in preventing toner from being adhered to roll surfaces completely.

As a means for preventing offsetting, various proposals were made. For instance, a cleaning pad constituted by a felt, a blade and a roller, each of which is in pressed contact with a heating roll, were proposed [Japanese Patent Laid-Open Nos. 57-44168, 56-52784 and 57-105760, Japanese Patent Publication No. 51-10108].

However, when the cleaning pad is used, its area in contact with the heating roll is so limited that its service life is too short, making it necessary to exchange it every 2000–3000 copies and also making its maintenance frequent and troublesome. Thus, the cleaning pad cannot effectively be used in a recent high-speed fixing apparatus.

In the systems using the toner-removing roller pressed onto a heating roll, the difference in surface energy between the heating roll and the toner-removing roller is utilized to transfer the toner from the heating roll to the toner-removing roller. However, control of pressing pressure of the toner-removing roller to the heating roll is difficult, and replacement of the surface member of the toner-removing roller is troublesome.

In addition, in the system of using the blade, the heating roll should have a relatively hard or rigid surface, but when the heating roll is coated with a heat-resistant, elastic layer as a surface layer, the blade cannot be used. That is, if the blade is pressed to the heating roll provided with a heat-resistant, elastic surface layer, both side edge portions of the heating roll are deformed in a wavelike manner, making it impossible to fix a toner image with high fidelity to a toner image-bearing sheet member. It also drastically reduces the service life of heat rolls.

OBJECT AND SUMMARY OF THE INVENTION

An object of the present invention is, therefore, to solve the problems peculiar to the above conventional techniques, thereby providing a heat-fixing apparatus capable of producing a high-quality fixed toner image without causing offsetting of toner image by keeping a heating roll and a pressure roll always clean.

To achieve the above object, the heat-fixing apparatus according to the present invention comprises a heating roll to be brought into contact with a toner image formed on a sheet member, the heating roll having a heat-resistant, elastic layer formed on a cylindrical core and a resin layer having good release properties formed thereon; a pressure roll arranged in contact with the heating roll to form a nip therebetween; a cleaning roll made of metal material and rotatably pressed to the heating roll: and a scraper slidably in contact with the outer surface of the cleaning roll.

By this structure, when the heating roll coated with a release resin surface layer is brought into contact with the metal cleaning roll, the toner is tranferred from the heating roll to the cleaning roll due to the difference in surface energy therebetween. The toner transferred to the cleaning roll is then removed by the scraper mounted near the cleaning roll. Thus, the heating roll is always kept clean.

DETAILED DESCRIPTION OF THE PREFERRED EMBODIMENTS

The present invention will be described in detail referring to the attached drawings.

Figure 1:
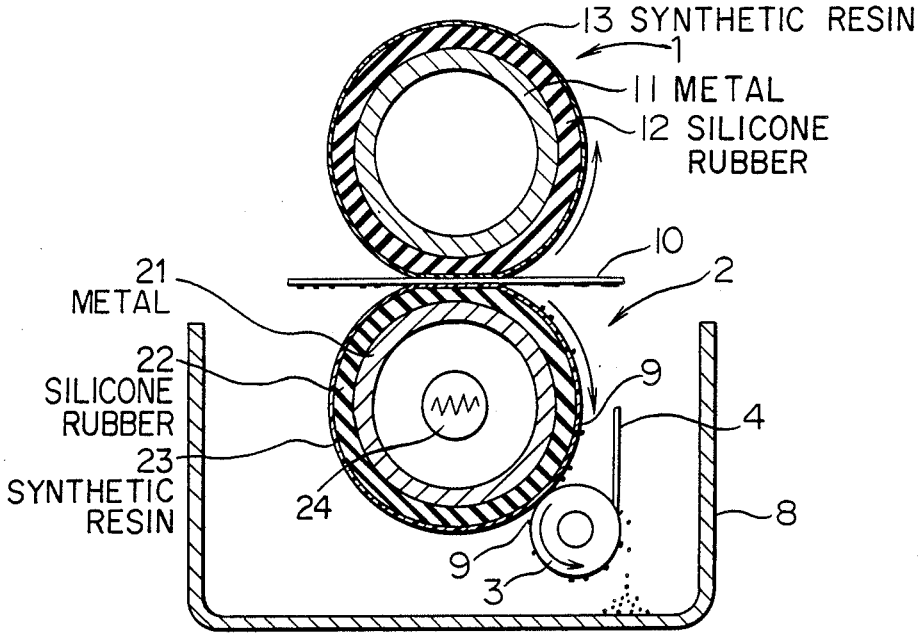
FIG. 1 is a cross-sectional view showing a heat-fixing apparatus according to one embodiment of the present invention.

FIG. 1 shows a pressure roll and a heating roll arranged in pressed contacted with each other according to the present invention. In FIG. 1, 1 denotes a pressure roll and 2 a heating roll, both of which have substantially parallel axes and are rotatable in the directions shown by the arrows. Both rolls 1, 2 are in contact with each other at a proper pressure. The pressure roll 1 is constituted by a hollow cylindrical core 11 made of materials with good thermal conductivity such as aluminum alloys, iron, etc. and coated with a heat-resistant, elastic coating layer 12 such as a silicone rubber layer or a fluorine rubber layer, and a release resin layer 13 made of a fluorine resin such as PTFE, PFA, etc. The heating roll 2 is constituted by a cylindrical core 21 made of materials with good thermal conductivity and containing a heat source 24 such as a halogen lamp. The cylindrical core 21 is coated with a heat-resistant, elastic layer 22 and a release resin layer 23.

The numeral 3 denotes a cleaning roll made of a metal material such as stainless steel, etc. The cleaning roll 3 is rotatably in contact with the heating roll 2. The cleaning roll 3 is driven by the rotation of the heating roll 2. The numeral 4 denotes a scraper made of a resilient metal material such as phosphor bronze in the shape of a thin plate, which is arranged near the cleaning roll 3 in such a manner that it is slidably in contact with the cleaning roll 3 substantially in the direction of its tangent. The numeral 8 denotes a toner collector.

In the heat-fixing apparatus of the above structure, the pressure roll 1 and the heating roll 2 are pressed to each other by pressing means [not shown], and the heating roll 2 is heated by the heat source 24. In this condition, each roll 1, 2 is rotated in the direction shown by the arrow, and a toner image-bearing sheet member 10 is supplied from left to a gap between the pressure roll 1 and the heating roll 2 in FIG. 1, thereby conducting the fixing of the toner image. In this case, some of the toner particles 9 inevitably adhere to the surface of the heating roll 2, but the toner particles 9 adhered to the heating roll 2 come in contact with the cleaning roll 3 by the rotation of the heating roll 2, and the toner particles 9 are transferred from the heating roll 2 to the cleaning roll 3. This is because the cleaning roll 3 made of stainless steel, etc. has a larger surface energy than the release resin layer 23 of the heating roll 2. The toner particles transferred to the cleaning roll 3 are scraped off by the scraper 4 and fall into the toner collector 8. Accordingly, the surface of the heating roll 2 which is again to be brought into contact with the toner image borne on the sheet member 10 is always kept clean.

As described above, the cleaning roll 3 serves to strip the heating roll 2 of the toner particles 9. To achieve a good cleaning function the toner particles adhered to the surface of the heating roll 2 should easily be transferred to the surface of the cleaning roll 3. In this case, if the surface roughness of the cleaning roll 3 is too small, the toner particles are less likely to adhere to the surface of the cleaning roll 3. Accordingly, the cleaning roll 3 desirably has a surface roughness [JIS B 0601] larger than 1S.

On the other hand, to prevent offsetting, the cleaning roll 3 should be brought into contact with the heating roll 2 in a state that as few toner particles as possible are adhered to the surface of the cleaning roll 3. According to experiments by the inventors, if the toner particles remain on the surface of the cleaning roll 3 when the heat-fixing apparatus is idle, the toner particles are likely to adhere to the heating roll 2 again. Therefore, it is necessary to remove the toner particles transferred from the heating roll 2 to the cleaning roll 3 by a scraper 4. For this purpose, the surface of the cleaning roll 3 should not be too rough. Specifically, the cleaning roll 3 desirably has a surface roughness of 8S or less. Taking into consideration both cleaning function and offsetting, the preferred surface roughness of the cleaning roll 2 is 3–6.3S.

Such surface roughness of the cleaning roll 3 can be produced by grinding, etc.

In the present invention, the cylindrical cores 11, 21 constituting the pressure roll 1 and the heating roll 2 are advantageously made of aluminum alloys for reducing the total weight of the heat-fixing apparatus, but any other metal materials than aluminum alloys can be used. Next, the elastic materials coated on the cylindrical cores 11, 21 may be a silicone rubber, a fluorine rubber or a mixture of a fluorine rubber and a fluorine resin (See, Japanese Pat. Laid-Open Nos. 59-217010 and 60–205561. Further, the elastic layer may have a multilayer structure in combination with different rubbers.

Each release resin surface layer 13, 23 having small surface energy for constituting the outer surface of each roll 1, 2 has desirably a thickness of 10–50 μm.

Incidentally, in this embodiment, the heating roll 2 contains a halogen lamp as the heat source 24, but it should be noted that the heating roll 2 may be directly heated by a heat-generating layer made of an electrically resistant material and coated on the cylindrical core.

Materials for constituting the cleaning roll 3 and the scraper 4 may be stainless steel, phosphor bronze, aluminum alloys, brass, etc.

Figure 2:
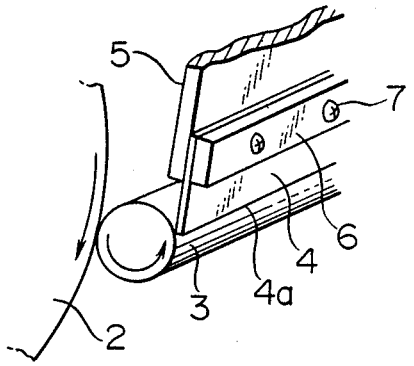
FIG. 2 is a schematic perspective view partially showing the cleaning roll in the heat-fixing apparatus of FIG. 1.

Referring to FIG. 2, the scraper 4 is fixed to a support plate 5 extending in parallel with the axes of both rolls 1, 2, by a holding plate 6 and a plurality of screws 7 in the heat-fixing apparatus. In this structure, when the heating roll 2 is heated, the heat is conducted to the scraper 4 via the cleaning roll 3, leading to thermal expansion of the scraper 4. In this case, however, if the scraper 4 is firmly gripped by the holding plate 6 as shown in FIG. 2, its root end gripped by the holding plate 6 cannot thermally expand freely. On the other hand, a free end of the scraper 4a (on the side of contact with the roller 3) is thermally expanded. Accordingly, it is deformed in a wavelike shape, producing a gap space between the cleaning roll 3 and the scraper 4. This is due to the fact that the scraper 4 is elongated most in the direction parallel with the axis of the cleaning roll 3 (longitudinal direction). As a result, uneven contact between the cleaning roll 3 and the scraper 4 ensues, resulting in the deterioration of cleaning function.

Figure 3:
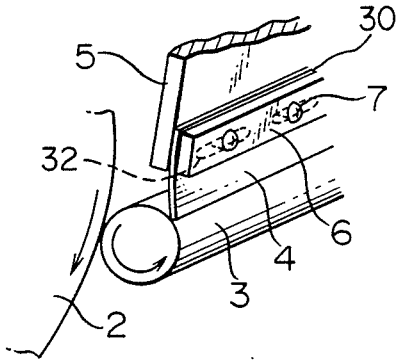
FIG. 3 is a schematic perspective view partially showing the cleaning roll according to another embodiment of the present invention.

To avoid such problem, a slight gap 30 is provided between the support plate 5 and the holding plate 6 as shown in FIG. 3 according to one preferred embodiment of the present invention. Specifically, the gap 30 between the support plate 5 and the holding plate 6 is slightly larger than the thickness of the scraper 4, so that the scraper 4 can move longitudinally. Screw holes 32 of the scraper 4 are preferably elongated longitudinally to permit it to move longitudinally. Thus, even though the scraper 4 is thermally expanded conspicuously in the longitudinal direction, no deformation of the scraper 4 takes place. On the other hand, a relative position of the scraper 4 to the cleaning roll 3 is always kept such that it remains in contact with the cleaning roll 3. Since the scraper 4 is longitudinally expandable without obstruction, it can avoid any undesirable deformation. Further, the condition of slidable contact of the cleaning roll 3 with the scraper 4 is never affected. Although the gap between the support plate 5 and the holding plate 6 is preferably larger than the thickness of the scraper 4, they may be the same as long as the scraper 4 can move relative to the holding plate 6 by thermal expansion.

In the heat-fixing apparatus shown in FIG. 1, since the heating roll 2 and the pressure roll 1 are both covered with release resin layers, the offsetting of a toner image can be effectively prevented even in the copying on both sides of paper sheets.

This heat-fixing apparatus is effectively used in a printer for directly printing letters such as addresses on a large number of envelopes. The envelope has a portion in which two or more plies of papers overlap each other, and some glued portions or overlapped portions may have 3 or 4 plies of papers. In the conventional fixing apparatus, creasing is likely to take place on the envelopes because the surface of a pressure roll is elastically deformed or dented in a nip portion between a heating roll and a pressure roll. On the contrary, in the apparatus shown in FIG. 1, the nip portion is substantially flat in the width direction, that is, transverse to longitudinal axes of the heating roll 2 and pressure roll 1, preventing the creasing of sheet members such as envelopes.

Incidentally, to achieve good heat-fixing of a toner image on envelopes, the heat-fixing apparatus should meet the following requirements which are described in detail in a co-pending U.S. application (Ser. No. 105,538 filed on October 8, 1987).

First, to prevent the creasing of envelopes, the surface hardness (A-type spring hardness, measured by JIS K 6301) of the heating roll 2 should be as close to that of the pressure roll 1 as possible. Specifically, the difference in surface hardness between them (simply "hardness difference") is desirably, 15° or less. More desirably, the surface hardness difference Hs is 10° or less.

Further, the difference in outer diameter between the heating roll 2 and the pressure roll 1 is desirably as small as possible. Specifically, the outer diameter difference is 5 mm or less, and more preferably 2 mm or less. And it is most preferably zero to completely prevent the creasing of envelopes.

Next, to achieve high fixability, a nip portion between the pressure roll 1 and the heating roll 2 should have a sufficient width. The nip width is usually 3–5 mm for good fixing. For this purpose, each roll 1, 2 should have a surface hardness Hs of 85° or less. If the pressure roll 1 and the heating roll 2 have a surface hardness Hs exceeding 85°, the desired nip width cannot be provided at a proper contact pressure between the two rolls. In this case, when the contact pressure of the two rolls is increased to get the desired nip width, the toner image-bearing sheet member is deformed, producing undesirable phenomena such as a shortened service life, creasing, etc. The preferred surface hardness is 80° or less. However, if the surface hardness is too low, good fixing cannot be achieved, either. Accordingly, the Hs of both rolls 1, 2 is desirably 20° or more.

In connection with the surface hardness, the heat-resistant elastic layer should have a proper thickness to achieve good fixing. Specifically, if the heating roll 2 has a heat-resistant, elastic layer 12 having a thickness less than 0.5 mm, the layer 12 shows little effect as an elastic layer, making it difficult to maintain the desired hardness and uniformness of the roll surface. On the other hand, when the thickness exceeds 2 mm, the heating roll 2 not only has an uneven temperature distribution, but also the conduction of heat is hindered, resulting in overheating of both ends of the heat roll 2 on which the paper never passes, causing unpredictable accidents.

And when a material constituting the elastic layer 12 formed in the heating roll 2 has a thermal conductivity of less than $0.6\times10^{-3}$ cal/cm.sec.° C., conduction of heat is insufficient in the heating roll 2, making the temperature distribution uneven on the heating roll 2 and also causing partial heating. The preferred thermal conductivity of the elastic layer 12 is $1.5\times10^{-3}$ cal/cm.sec.° C. or more. Incidentally, to increase the thermal conductivity of the elastic layer 12 more than $1.5\times10^{-3}$ cal/cm.sec.° C., it should contain thermally conductive materials such as carbon black, metal oxides such as titanium oxide, etc. The inclusion of such thermally conductive materials in large amounts, however, results in the surface hardness Hs exceeding 85°, making it difficult to ensure a sufficient nip width.

In the apparatus of FIG. 1, since the pressure roll 1 has larger rigidity than the conventional one, both rolls 1, 2 should be in contact with each other at higher contact pressure which enables it to ensure the desired nip width. Specific contact pressure may be determined by taking into consideration a fixing speed and a fixing temperature. Specifically when the fixing speed is 50–100 mm/sec and the fixing temperature is 190° C. or so, the contact pressure of the two rolls is desirably 0.8 kg/cm or more in linear pressure, and more preferably 1.2 kg/cm or more. As far as creasing is concerned, the contact pressure may be as high as 10–20 kg/cm as in pressure fixing. However, when the linear pressure becomes too large, a service life of this apparatus is shortened because of plastic deformation of the rubber layer, and so it is preferably 3.0 kg/cm or less.

Because of the above structure, the toner particles adhered to the heating roll can be consistently removed without damaging the surface of the heating roll, thereby keeping clean the rolls constituting the heat-fixing apparatus. Therefore, paper sheets or any other sheet members such as envelopes can be used without contamination with toner particles.

The present invention has been explained by the above embodiments, but it should be noted that any modifications can be made unless they deviate from the scope of the present invention defined by the claims attached hereto.

What is claimed is:

1. A heat-fixing apparatus comprising a heating roll to be brought into contact with a toner image-bearing sheet member, said heating roll being constituted by a cylindrical core coated with an elastic layer; a pressure roll, said pressure roll being in pressed contact with said heating roll to provide a flat nip portion of a certain width therebetween; a cleaning roll, said cleaning roll being rotatably in pressed contact with said heating roll; and a scraper in slidable contact with the outer surface of said cleaning roll, said scraper being supported by a support plate and a holding plate and being movable longitudinally with respect to said support plate and said holding plate to prevent the deformation of said scraper due to its thermal expansion, wherein said scraper is mounted between said support plate and said holding plate by one or more mounting members extending through respective apertures in said scraper; and wherein said holding plate is spaced from said support plate a distance greater than the thickness of said scraper and said scraper mounting apertures are elongated in the longitudinal direction, for permitting longitudinal movement of said scraper.

2. The heat-fixing apparatus according to claim 1 wherein the elastic layer is made of a silicone rubber and/or a flourine rubber and having a thickness of 0.5–2 mm, and with a resin surface layer made of a perfluoroalkoxy-tetrafluoroethylene copolymer (PFA) and having a thickness of 10–50 $\mu$m.

3. The heat-fixing apparatus according to claim 1 wherein the pressure roll has a layered structure and outer diameter substantially as those of said heating roll.

4. The heat-fixing apparatus according to claim 1 wherein said cleaning roll is made of a metal material and has a surface roughness larger than 1S.

* * * * *

UNITED STATES PATENT AND TRADEMARK OFFICE

CERTIFICATE OF CORRECTION

PATENT NO. : 4,949,130

DATED : August 14, 1990

INVENTOR(S) : Mitsuhiro Torino

It is certified that error appears in the above-identified patent and that said Letters Patent is hereby corrected as shown below:

Claim 3, column 8, line 11, insert --the same-- after "substantially".

In the Abstract, line 5, change "inage" to --image--.

Signed and Sealed this

Fourteenth Day of January, 1992

*Attest:*

HARRY F. MANBECK, JR.

*Attesting Officer*

*Commissioner of Patents and Trademarks*